US010090620B2

(12) United States Patent
Suzuki et al.

(10) Patent No.: US 10,090,620 B2
(45) Date of Patent: Oct. 2, 2018

(54) LEVER-TYPE CONNECTOR HAVING A LEVER WITH TWO ARMS WITH ONE ENDS OF THE ARMS JOINED BY AN OPERATING PORTION AND OTHER ENDS JOINED BY A COUPLING

(71) Applicant: Sumitomo Wiring Systems, Ltd., Yokkaichi, Mie (JP)

(72) Inventors: Masakazu Suzuki, Mie (JP); Kazuo Nakai, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/724,350

(22) Filed: Oct. 4, 2017

(65) Prior Publication Data

US 2018/0109034 A1 Apr. 19, 2018

(30) Foreign Application Priority Data

Oct. 14, 2016 (JO) ..... 2016-202844

(51) Int. Cl.
*H01R 13/62* (2006.01)
*H01R 13/629* (2006.01)

(52) U.S. Cl.
CPC ..... *H01R 13/62933* (2013.01)

(58) Field of Classification Search
CPC ..... H01R 13/62; H01R 13/629; H01R 13/62922; H01R 13/62933; H01R 13/62977; H01R 13/639
USPC ..... 439/157, 159, 160
See application file for complete search history.

(56) References Cited

U.S. PATENT DOCUMENTS 6,065,982 A * 5/2000 Okabe ..... H01R 13/62933 439/157
6,183,277 B1 * 2/2001 Okabe ..... H01R 13/62955 439/157
7,396,240 B2 * 7/2008 Frederiksen ..... H01R 13/639 439/157
7,878,825 B2 * 2/2011 Matsumura ..... H01R 13/6295 439/157
8,221,142 B2 * 7/2012 Sakamaki ..... H01R 13/62955 439/157
9,142,916 B2 * 9/2015 Allgood ..... H01R 13/516
9,728,896 B2 * 8/2017 Papurcu ..... H01R 13/641
2006/0228921 A1 * 10/2006 Fukui ..... H01R 13/62955 439/157

(Continued)

FOREIGN PATENT DOCUMENTS

JP 2009-245609 10/2009

*Primary Examiner* — Chandrika Prasad
(74) *Attorney, Agent, or Firm* — Gerald E. Hespos; Michael J. Porco; Matthew T. Hespos

(57) ABSTRACT

A lever 30 includes two arms (31), a coupling (32) coupling base ends (31R) of the arms (31) and an operating portion (33) coupling tips (31F) of the arms (31). The lever (30) is supported rotatably on a housing (10) with rotary shafts (34) formed on the coupling (32) serving as a fulcrum. Two sliders (40) are mounted in the housing (10) while being fit to drive shafts (38) of the lever (30) and slide in conjunction with the rotation of the lever (30). The sliders (40) are formed with cam grooves (43) configured so that cam followers (53) of a mating housing (51) slide in contact with the cam grooves (43) as the sliders (40) are slid.

9 Claims, 14 Drawing Sheets

(56) References Cited

U.S. PATENT DOCUMENTS

| | | | | |
|---|---|---|---|---|
| 2007/0197021 | A1* | 8/2007 | Nam | H01L 21/76825 438/622 |
| 2011/0014805 | A1 | 1/2011 | Sakamaki et al. | |
| 2016/0285200 | A1* | 9/2016 | Eow | H01R 13/62938 |

* cited by examiner

LEVER-TYPE CONNECTOR HAVING A LEVER WITH TWO ARMS WITH ONE ENDS OF THE ARMS JOINED BY AN OPERATING PORTION AND OTHER ENDS JOINED BY A COUPLING

BACKGROUND

Field of the Invention

The invention relates to a lever-type connector.

Description of the Related Art

Japanese Unexamined Patent Publication No. 2009-245609 discloses a lever-type connector whose housing is connected to a mating connector by rotating a lever mounted on the housing. Rotation of the lever causes sliders mounted in the housing to move parallel to one another by the principle of leverage and pulls cam pins of the mating connector into cam grooves of the sliders.

The lever is made of synthetic resin and has a U-shape formed by two side plates and an operating portion that couples the ends of the side plates. A part of each side plate remote from the operating portion is engaged with one of the sliders. There is a problem that the lever easily is widened resiliently and deformed to move the side plates away from each other.

The invention was completed based on the above situation and aims to suppress the deformation of a lever.

SUMMARY

The invention is directed to a lever-type connector with a housing, a lever and two sliders. The lever has two arms, a coupling that couples base ends of the arms and an operating portion that couples tips of the arms. The lever is supported rotatably on the housing with the coupling or rotation supporting portions formed on the base ends of the arms serving as a fulcrum. The sliders are mounted in the housing while being fit to driving portions of the lever and are configured to slide in conjunction with the rotation of the lever. Cam grooves are formed in the sliders and are configured so that cam followers of a mating housing slide in contact with the cam grooves as the sliders are slid.

The lever couples both the base end parts of the arms and also the tips of the arms Thus, the lever has a high rigidity and is difficult to deform.

The rotation supporting portions may be shafts, and the housing may be formed with resiliently deformable bearings that are configured so that the rotation supporting portions are fit rotatably to the bearings. According to this configuration, even if the lever is not forcibly widened and deformed, the shaft-shaped rotation supporting portions can be fit to the bearings.

A back surface of the housing may define a wire draw-out surface from which a wire fixed to a terminal fitting in the housing is drawn out. The lever may be disposed along an outer periphery of the housing and the entire lever may be disposed closer to a front surface than to the wire draw-out surface when the lever is at an assembled position where the lever is completely assembled with the housing. According to this configuration, even if an external matter approaches from the back side of the housing with the lever located at the assembled position and the wire not drawn out from the wire draw-out surface, there is no possibility that the external matter interferes with the lever.

The lever may be rotatable from an assembled position where the lever is assembled completely with the housing to an initial position where the connection of the housing and the mating housing is started via a connection position where the connection of the housing and the mating housing is completed. The lever may be formed with a separation restricting portion capable of restricting separation of the lever from the housing by interfering with the slider when the lever is at the connection position with the driving portions fit to the sliders. According to this configuration, after the lever is assembled with the housing, the lever can be held assembled with the housing by being rotated to the connection position.

The separation restricting portion may be formed on the coupling or the base ends of the arms. According to this configuration, the separation restricting portion is arranged at a position near the rotation supporting portions so that separation of the rotation supporting portions from the housing can be prevented.

The lever and the sliders may be displaceable between an initial position where the connection of the housing and the mating housing is started and a connection position where the connection of the housing and the mating housing is completed. The lever may be formed with a movement restricting portion configured to restrict displacements of the sliders in a direction opposite to that toward the connection position by being held in contact with the slider when the lever and the sliders are at the initial position. According to this configuration, if an attempt is made to rotate the lever at the initial position toward a side opposite to the connection position, the slider butts against the movement restricting portion to have a movement restricted. Thus, the rotation of the lever also is restricted.

DETAILED DESCRIPTION

Hereinafter, one specific embodiment of the present invention is described with reference to FIGS. 1 to 15. Note that, in the following description, a left side in FIGS. 1 to 3, 5 to 9 and 12 is defined as a front side concerning a front-rear direction. Upper and lower sides shown in FIGS. 1 to 7 and 9 to 15 are directly defined as upper and lower sides concerning a vertical direction.

Figure 1:
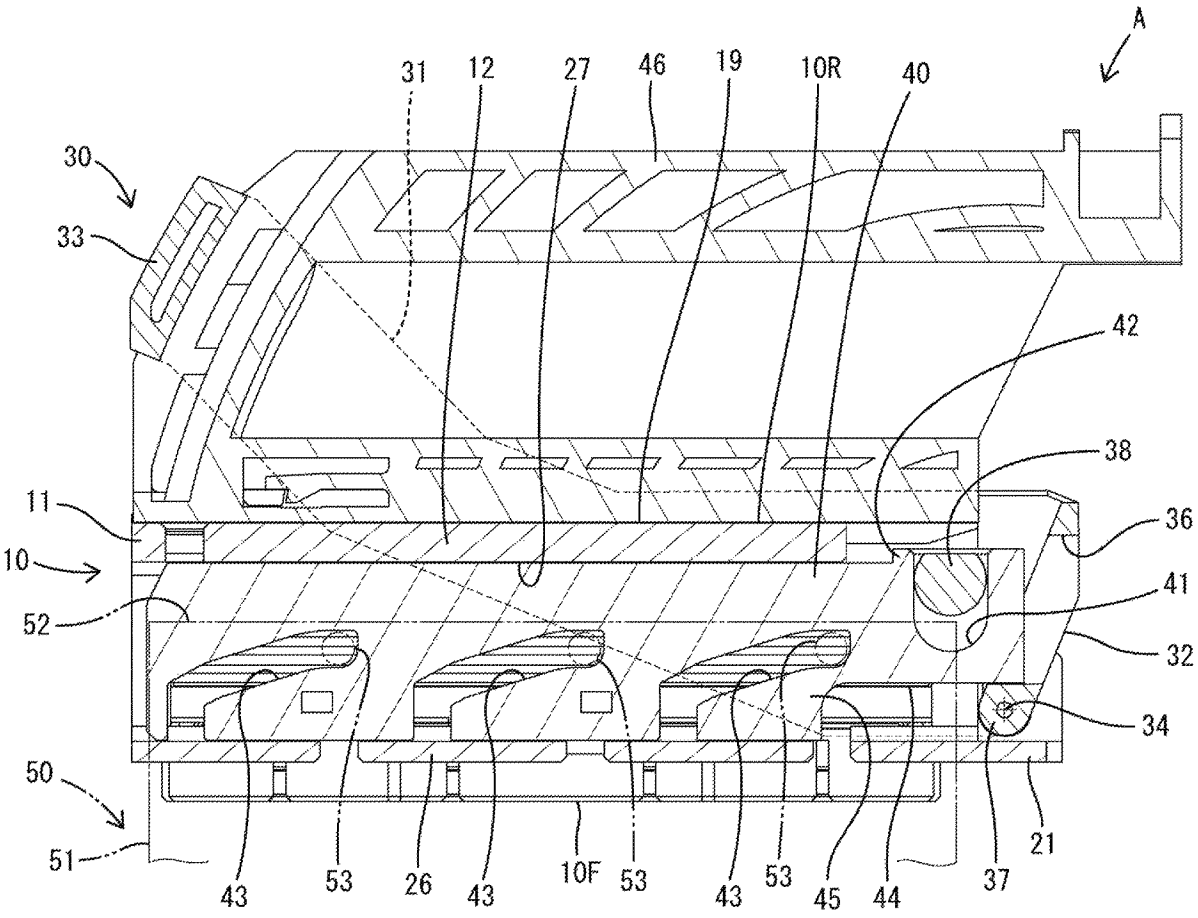
FIG. 1 is a side view in section of a lever-type connector showing a state where a lever and sliders are at a connection position in one embodiment.
Figure 2:
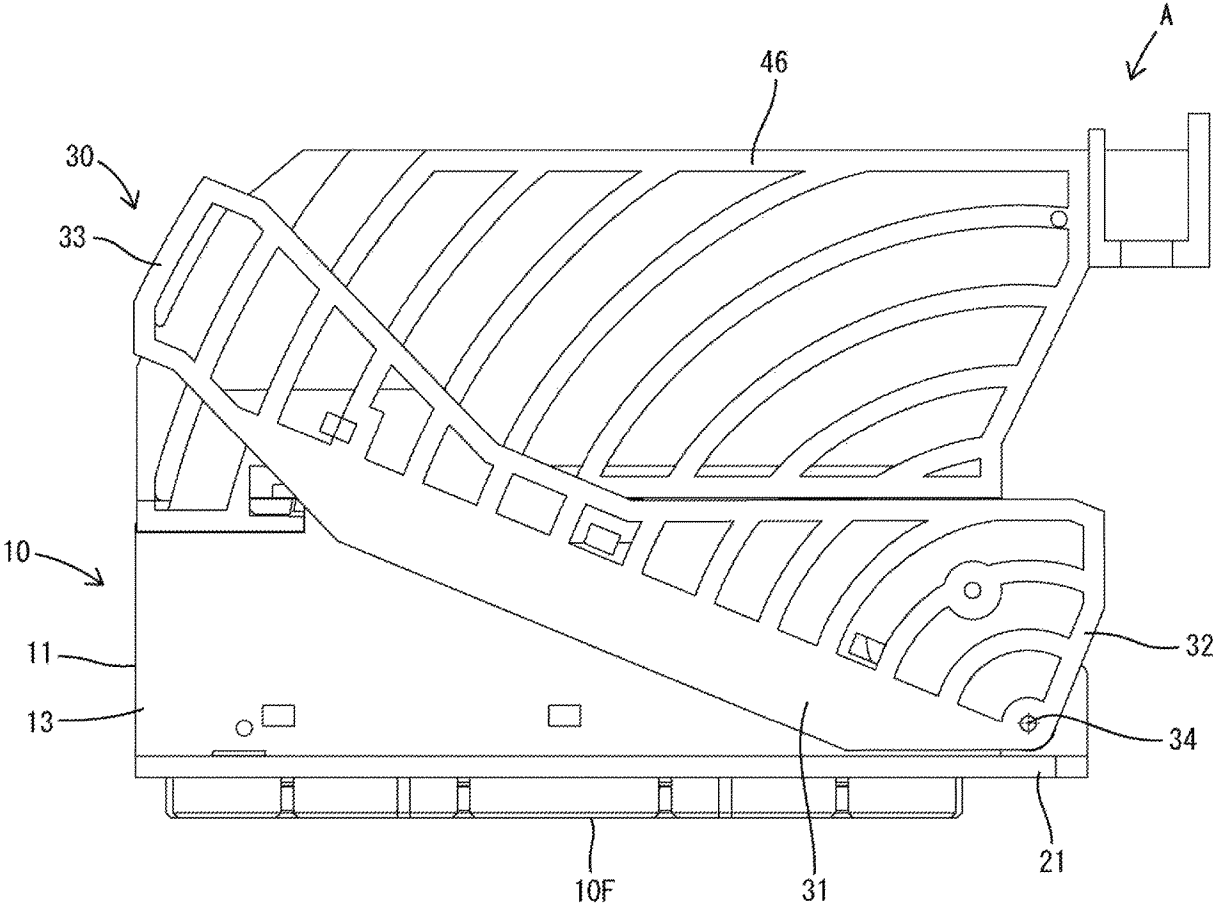
FIG. 2 is a side view of the lever-type connector showing the state where the lever and the sliders are at the connection position.
Figure 4:
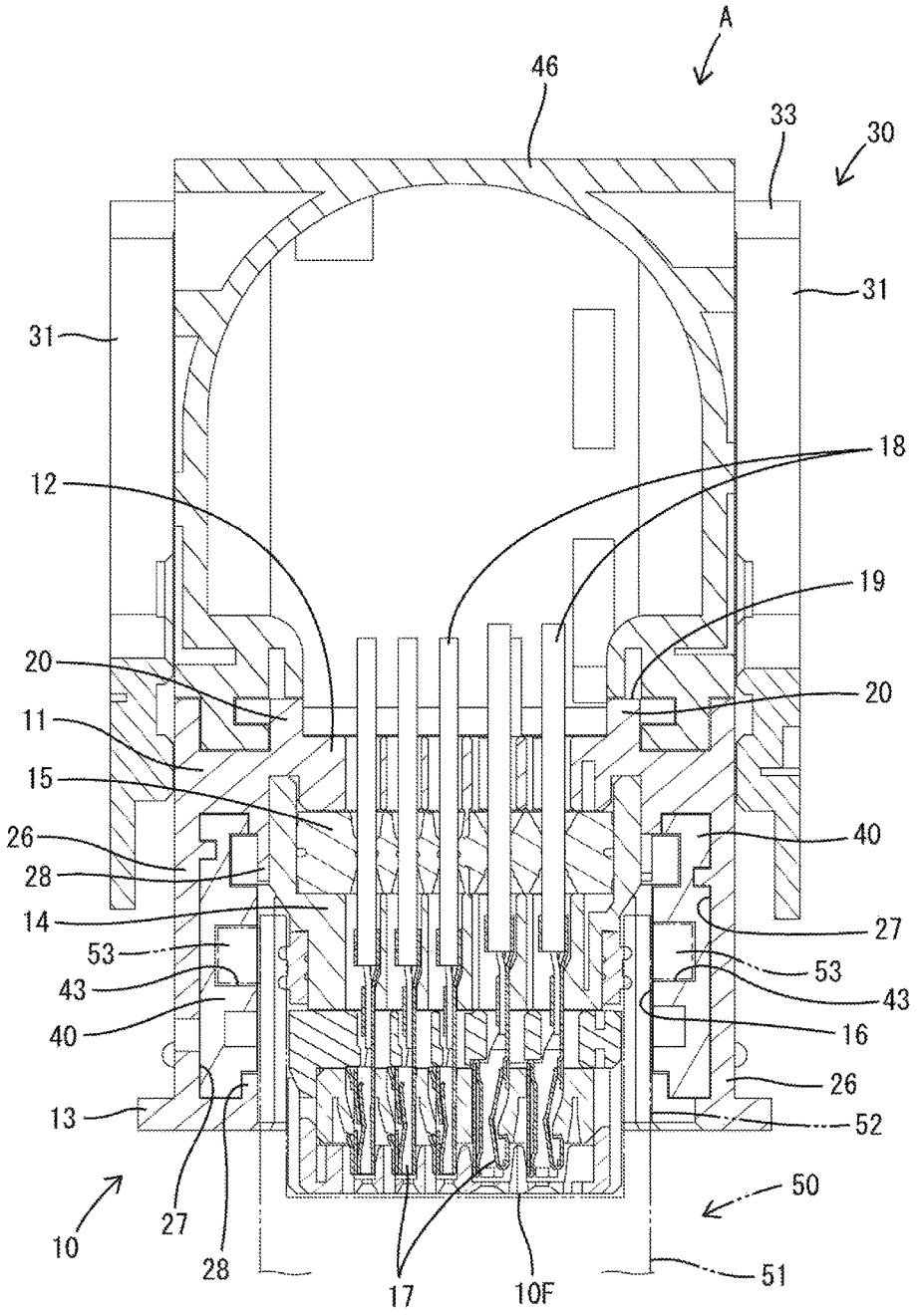
FIG. 4 is a back view in section of the lever-type connector showing the state where the lever and the sliders are at the connection position.
Figure 5:
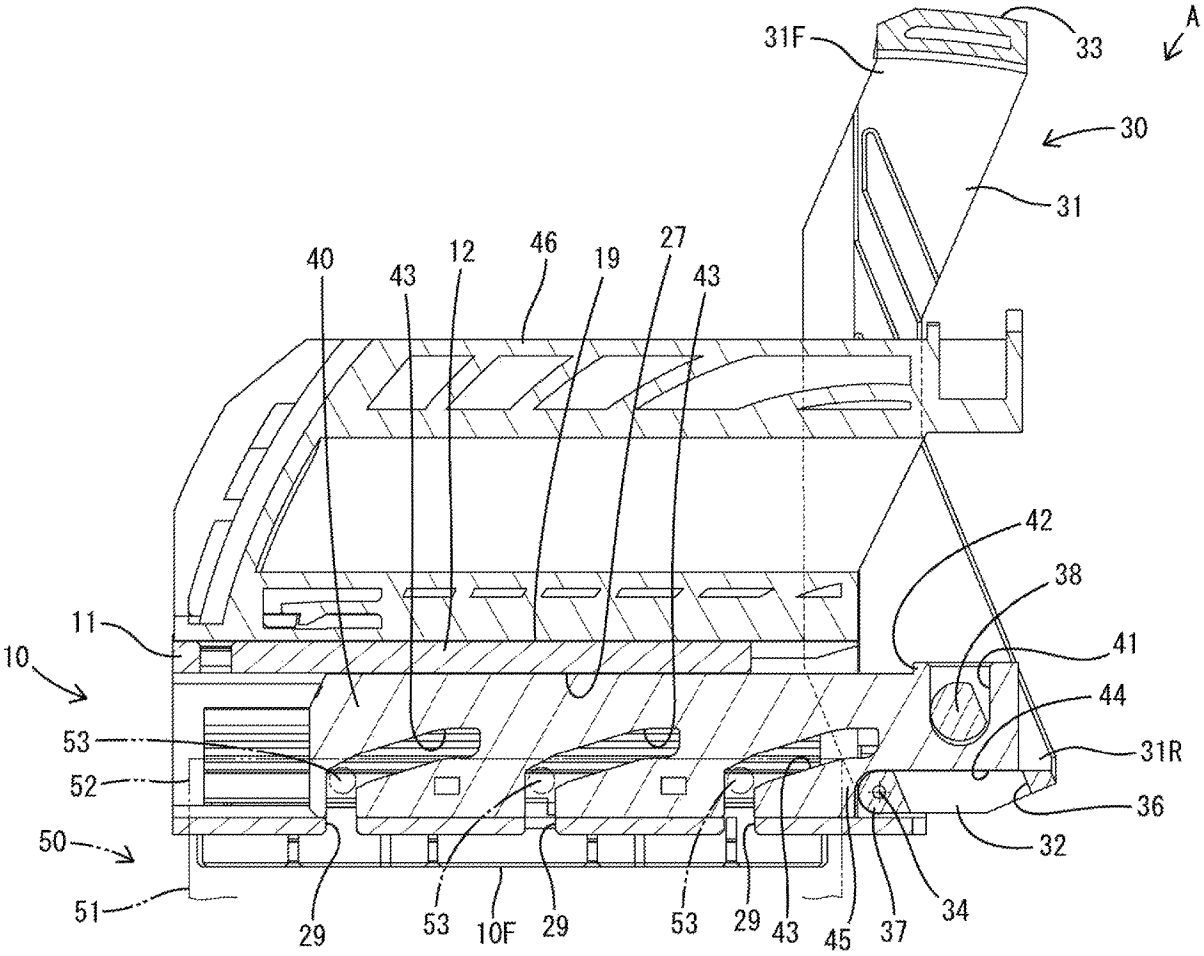
FIG. 5 is a side view in section of the lever-type connector showing a state where the lever and the sliders are at an initial position.

A lever-type connector A of this embodiment includes a booster mechanism and is connected to a mating male connector 50. As shown in FIGS. 1, 4 and 5, the mating connector 50 includes a mating housing 51 and male terminals (not shown) mounted in the mating housing 51. The mating housing 51 includes a receptacle 52 in the form of a rectangular tube long in the front-rear direction and open upward. Three cam followers 53 project at intervals in the front-rear direction on each of left and right outer side surfaces of the receptacle 52. The lever-type connector A is connected to the mating connector 50 from above. That is, a connecting direction of the lever-type connector A and the mating connector 50 is the vertical direction.

Figure 3:
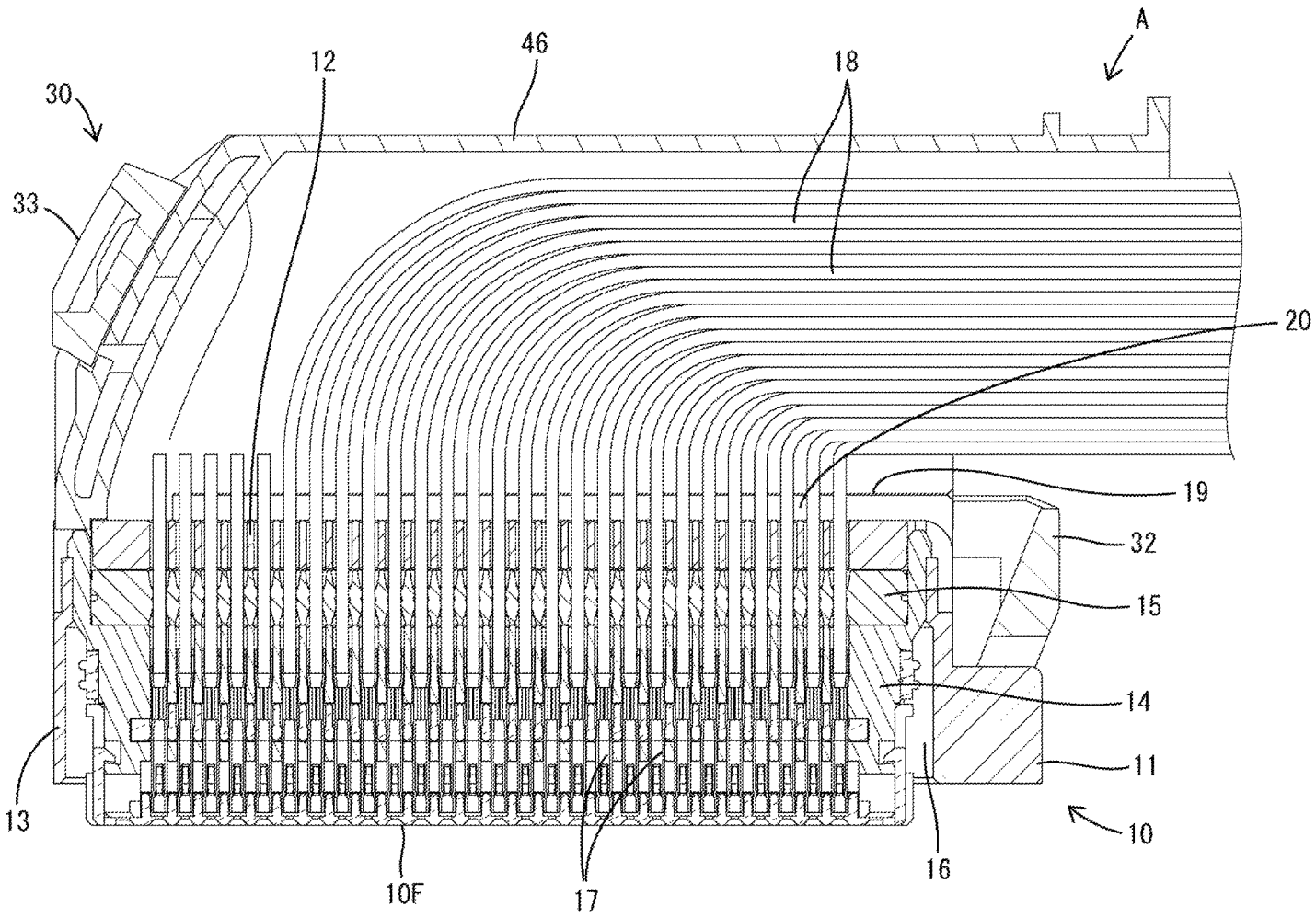
FIG. 3 is a side view in section of the lever-type connector.

As shown in FIGS. 3 and 4, the lever-type connector A includes a housing 10, a bilaterally symmetrical lever 30, two bilaterally symmetrical sliders 40 and a wire cover 46. In the description of the housing 10, a lower surface of the housing 10 is defined as a "front surface 10F" and an upper surface of the housing 10 is defined as a "back surface 10R". The housing 10 includes an outer housing 11 made of synthetic resin and an inner housing 14 made of synthetic resin.

The outer housing 11 includes a substantially horizontal back wall portion 12 having a substantially rectangular shape long in the front-rear direction, and a tubular fitting 13 projecting down (toward the front surface 10F of the housing 10) from the outer periphery of the back wall 12. The inner housing 14 is composed of two components overlapping one above the other. The inner housing 14 is disposed below the back wall 12 via a one-piece rubber plug 15, and a space between the outer periphery of the inner housing 14 and the inner periphery of the tubular fitting 13 serves as a connection space 16 into which the receptacle 52 is fit from below. A plurality of female terminal fittings 17 are accommodated inside the inner housing 14.

A wire 18 fixed to an upper end part of each terminal fitting 17 is drawn out upward of the housing 10 through the one-piece rubber plug 15 and the back wall 12. The back surface 10R of the housing 10 (outer housing 11) serves as a wire draw-out surface 19 for exposing a plurality of wires 18. Left and right edges of the wire draw-out surface 19 define raised portions 20 relatively higher than a wide area where insertion paths of the wires 18 are open. In the housing 10 (outer housing 11), the wires 18 drawn out upward from the wire draw-out surface 19 on which the wire cover 46 is mounted to cover the wire draw-out surface 19 are turned rearward in the wire cover 46 and pulled out rearward to the outside of the wire cover 46.

Figure 6:
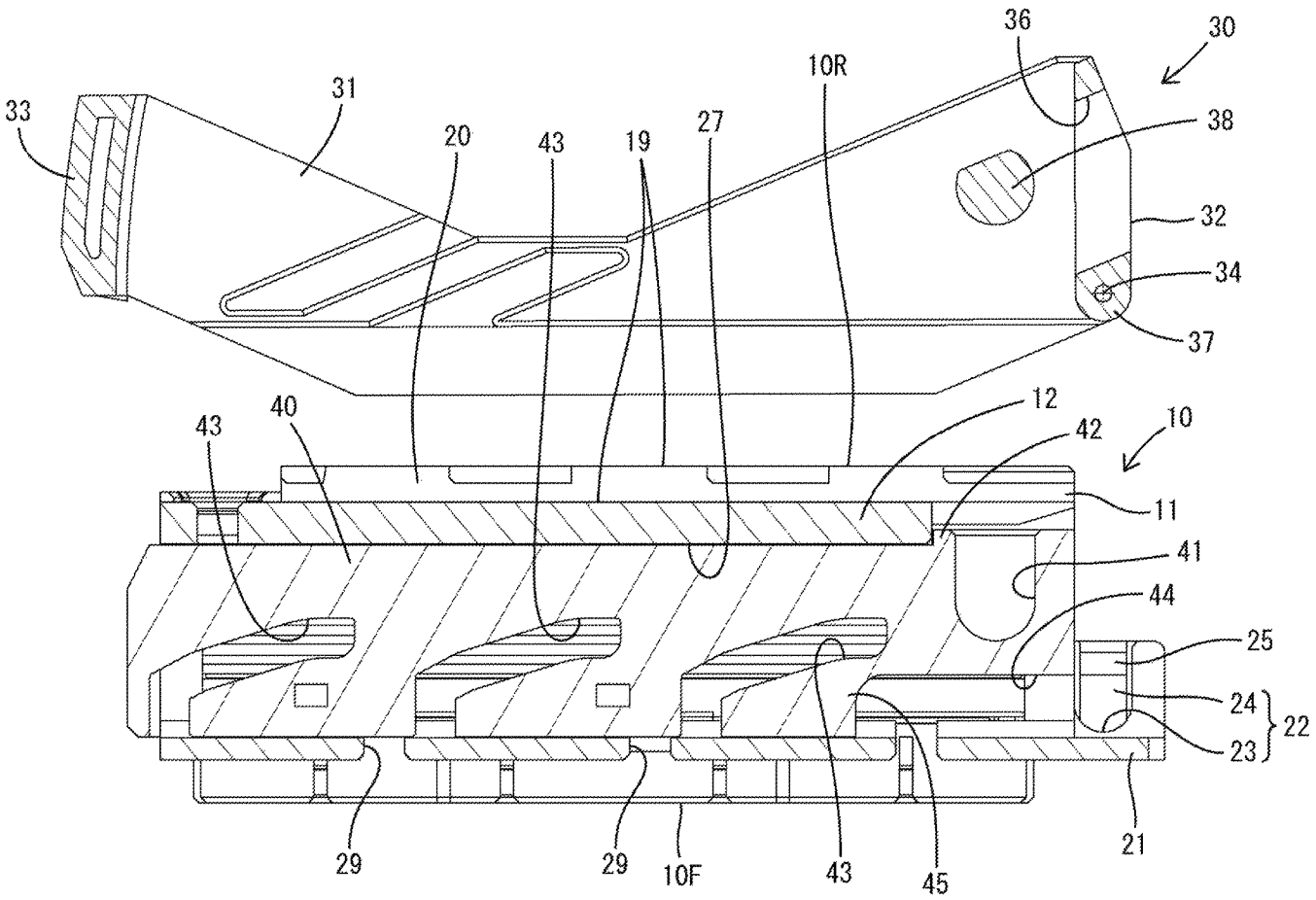
FIG. 6 is a side view in section showing a state where the lever is separated upwardly of a connector housing.
Figure 7:
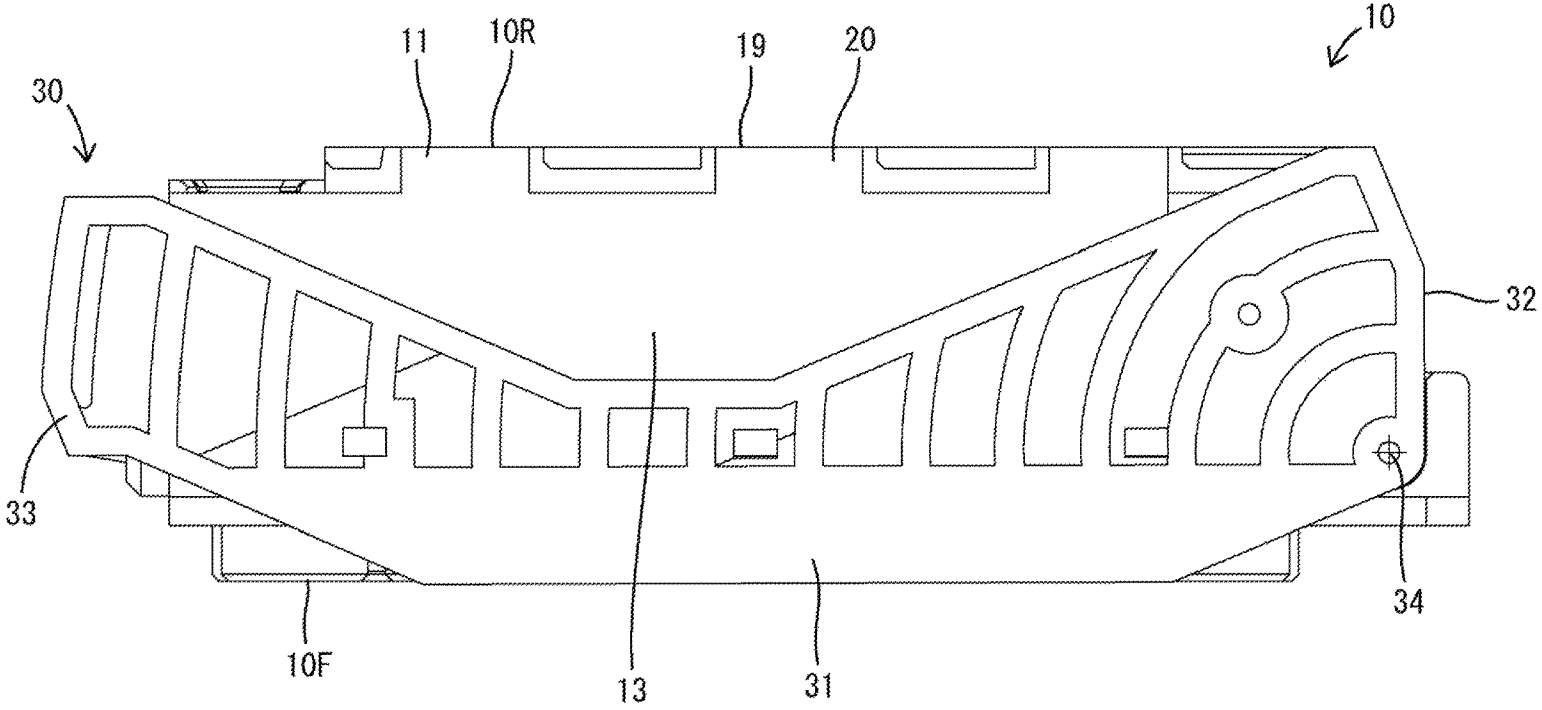
FIG. 7 is a side view showing a state where the lever mounted on the connector housing is at an assembled position.
Figure 8:
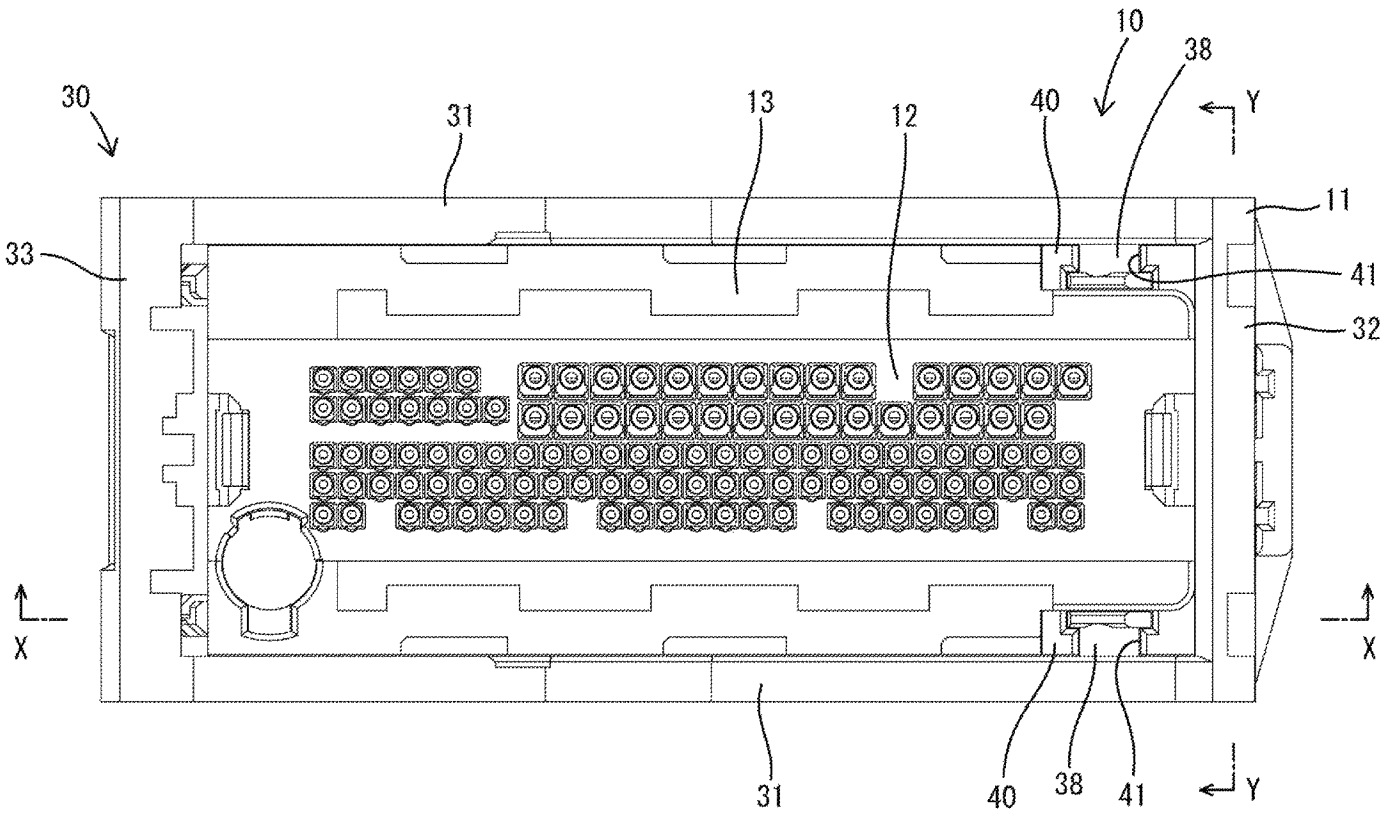
FIG. 8 is a plan view showing the state where the lever mounted on the connector housing is at the assembled position.
Figure 9:
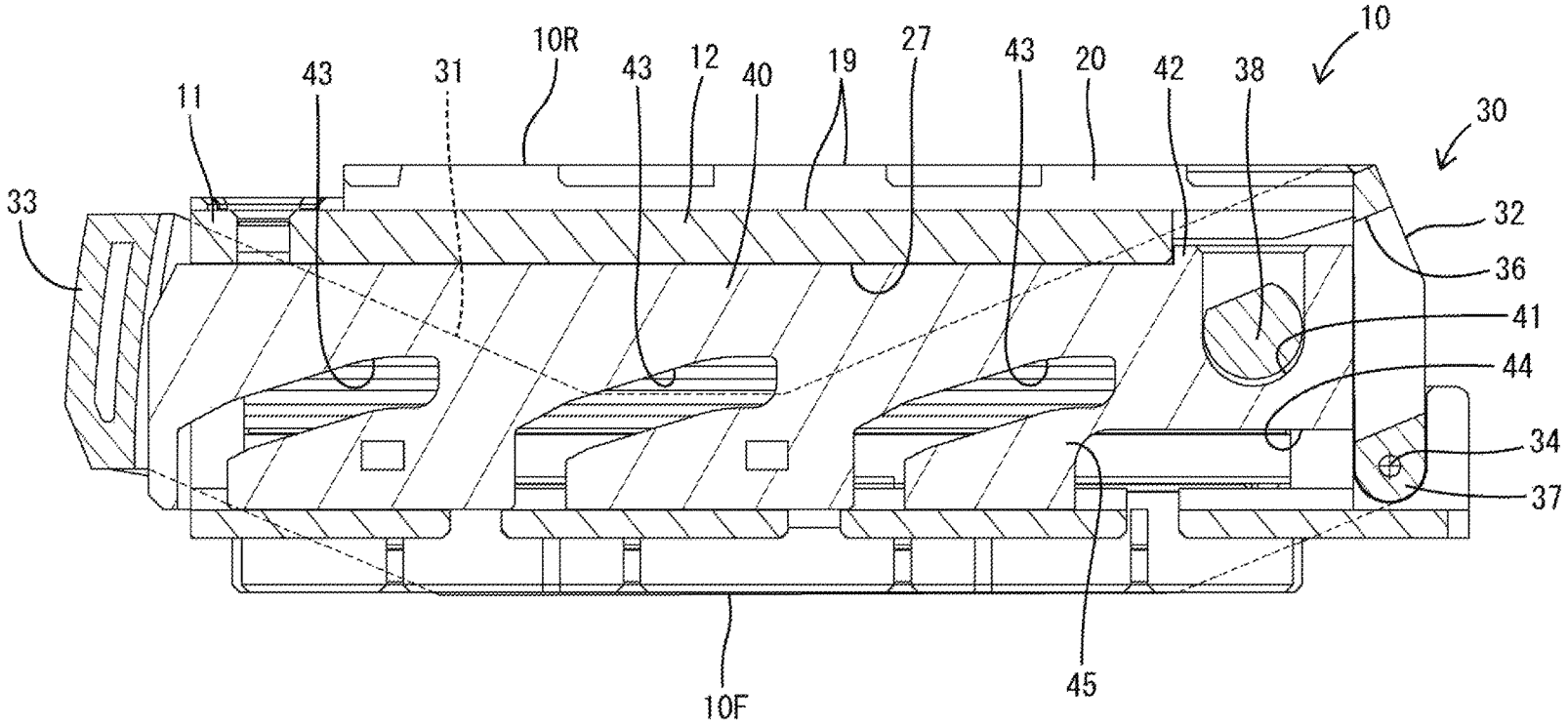
FIG. 9 is a section along X-X of FIG. 8.
Figure 10:
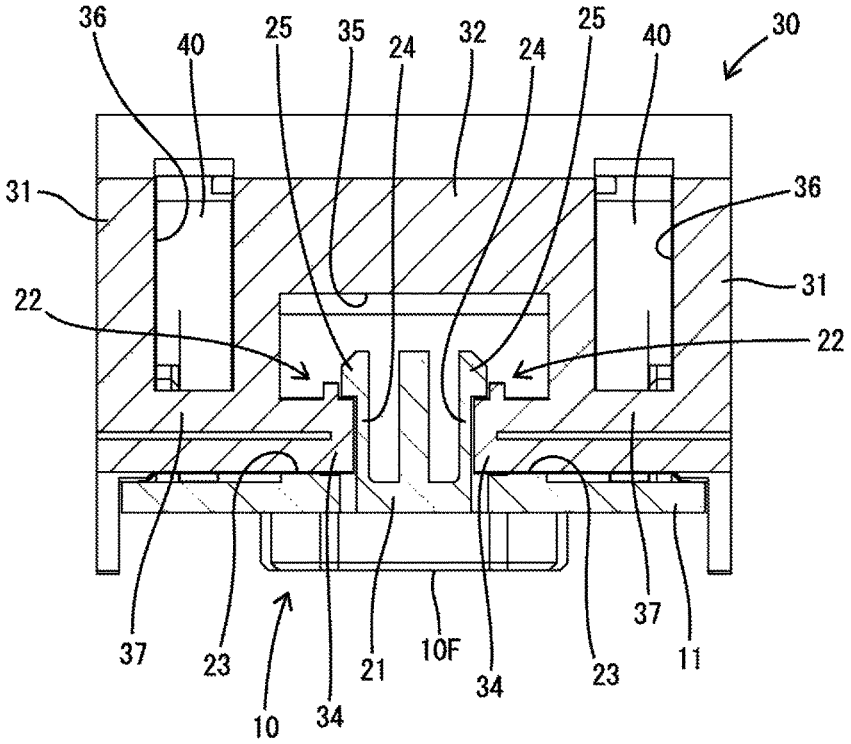
FIG. 10 is a section along Y-Y of FIG. 8.
Figure 12:
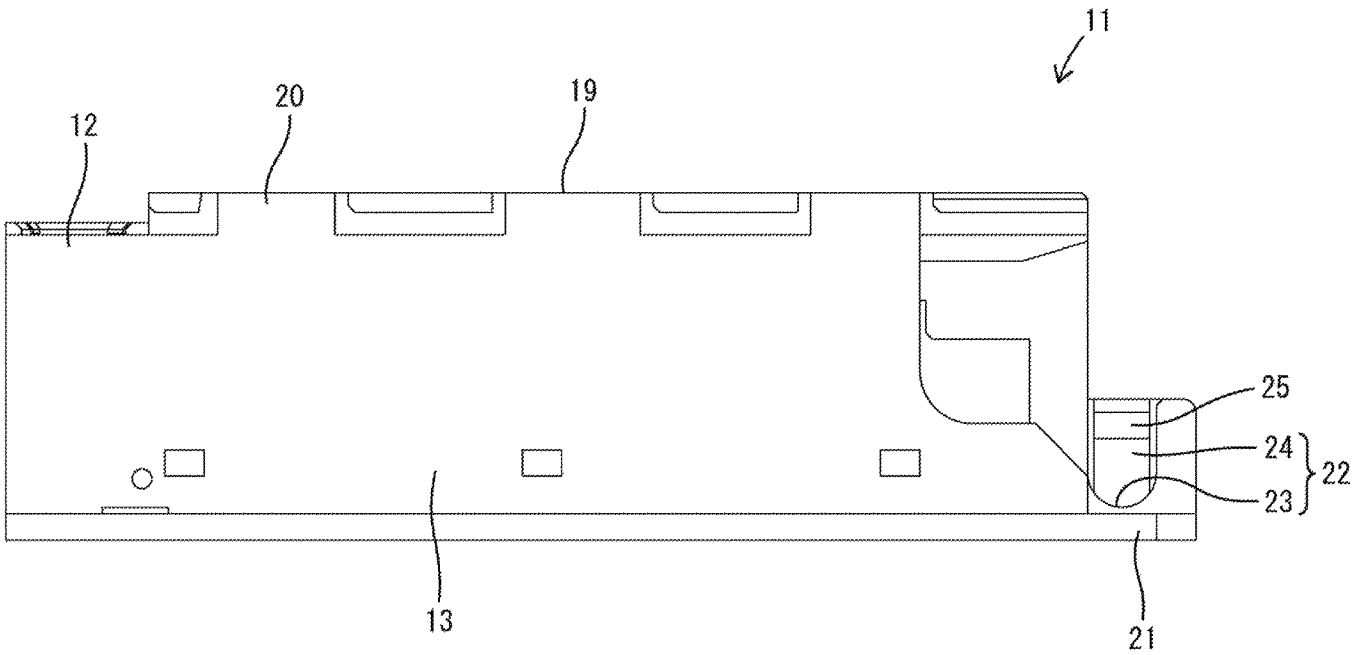
FIG. 12 is a side view of the outer housing constituting the connector housing.

A supporting wall 21 projecting rearward from the rear end edge of a lower end part of the tubular fitting 13 of the outer housing 11. Two bilaterally symmetrical bearings 22 are formed in a laterally central part of the side wall 21 and rotatably support the lever 30. As shown in FIGS. 6, 10 and 12, the bearings 22 include arcuate receiving portions 23 formed by recessing the upper surface of the side wall 21 to be substantially semicircular in a side view, and left and right resilient locking pieces 24 cantilevered up from positions between the arcuate receiving portions 23 on the upper surface of the side wall 21. Retaining projections 25 project laterally out on extending end parts of the resilient locking pieces 24. The resilient locking pieces 24 can be deformed resiliently to displace the retaining projections 25 toward a laterally central side (directions to bring the retaining projections 25 away from the arcuate receiving portions 23 in a plan view).

Figure 11:
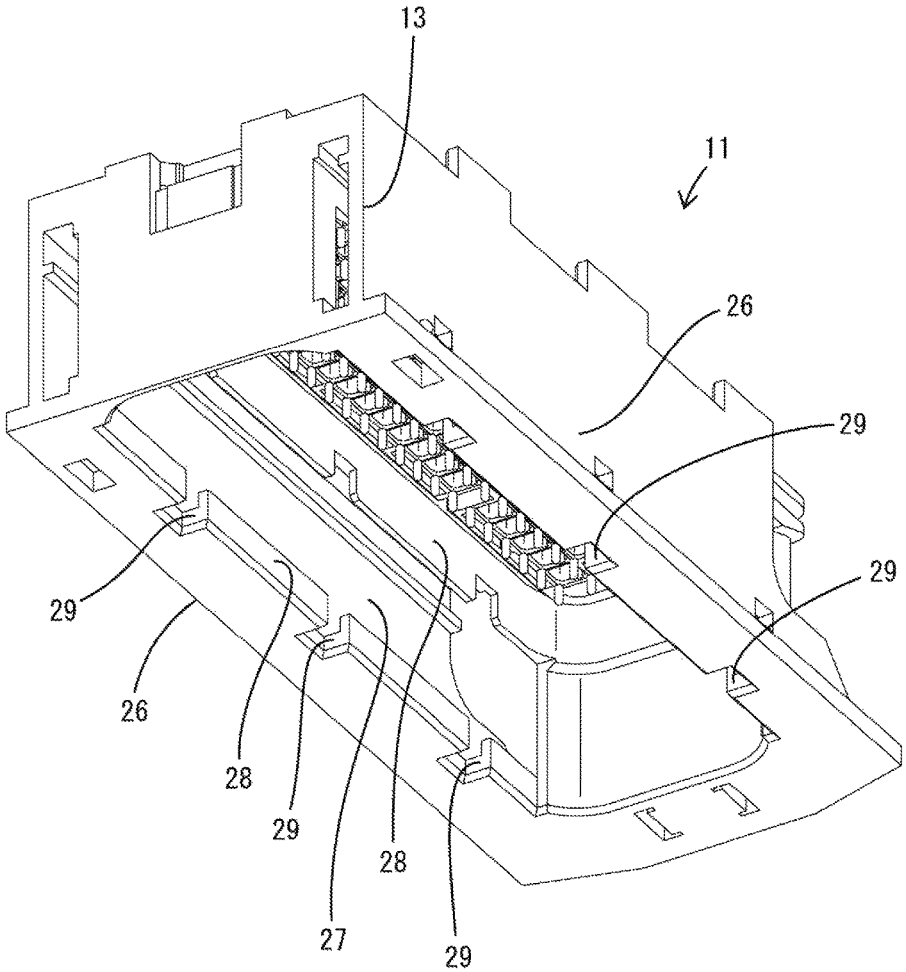
FIG. 11 is a perspective view of an outer housing constituting the connector housing.

As shown in FIGS. 1, 4 and 11, both left and right side walls 26 of the tubular fitting 13 of the outer housing 11 are formed with left and right guide recesses 27 for guiding the sliders 40 slidably in the front-rear direction (direction perpendicular to the connecting direction of the lever-type connector A and the mating connector 50). Each guide recess 27 is formed by shallowly recessing the inner surface (surface facing the inner housing 14 and the connection space 16) of the side wall 26 by a dimension substantially equal to a plate thickness of the slider 40. As shown in FIG. 4, restricting ribs 28 are formed on upper and lower end edges of the guide recess 27 for restricting the detachment of the slider 40 toward the connection space 16 (laterally inward) from the inside of the guide recess 27.

The front end of the guide recess 27 is open forward of the tubular fitting 13 (outer housing 11) to ensure a movement path for a front end part of the slider 40. The rear end of the guide recess 27 is open rearwardly of the tubular fitting 13 (outer housing 11) to ensure a movement path for a rear end part of the slider 40. Further, three entrance openings 29 are formed at intervals in the front-rear direction on each of lower end parts of the both left and right side walls 26 and communicate with the inside of the guide recess 27 from the lower end surface of the side wall portion 26.

Figure 13:
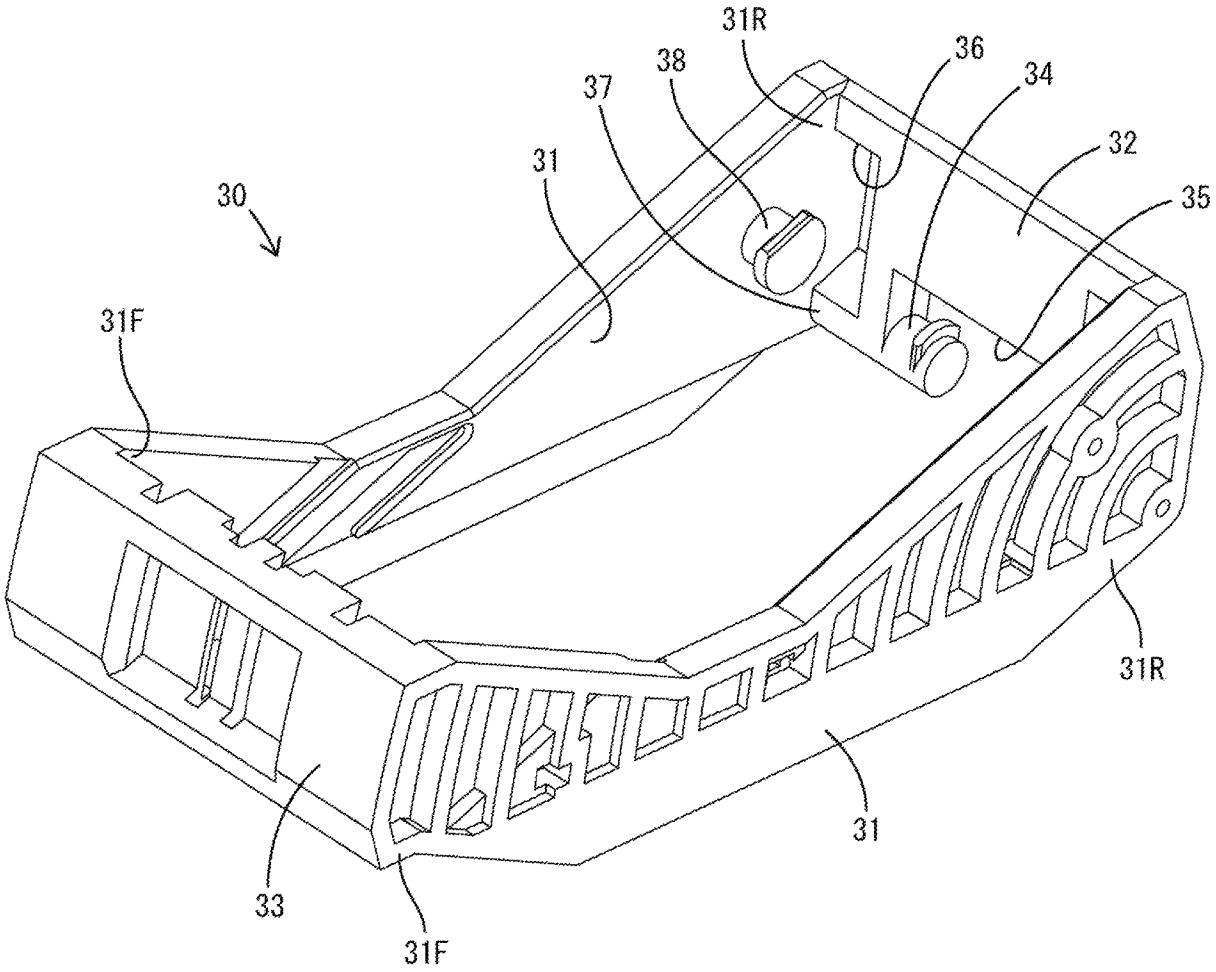
FIG. 13 is a perspective view of the lever.
Figure 14:
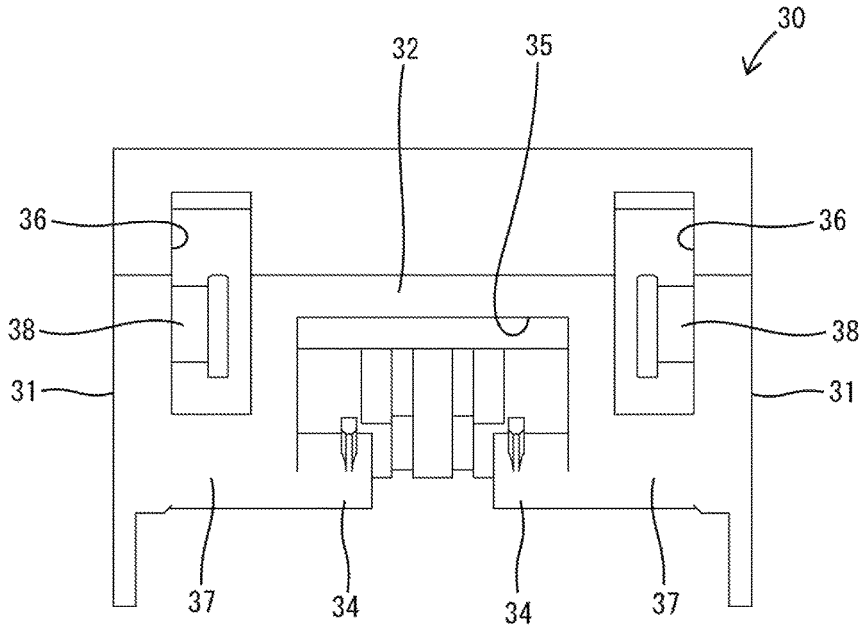
FIG. 14 is a back view of the lever.
Figure 15:
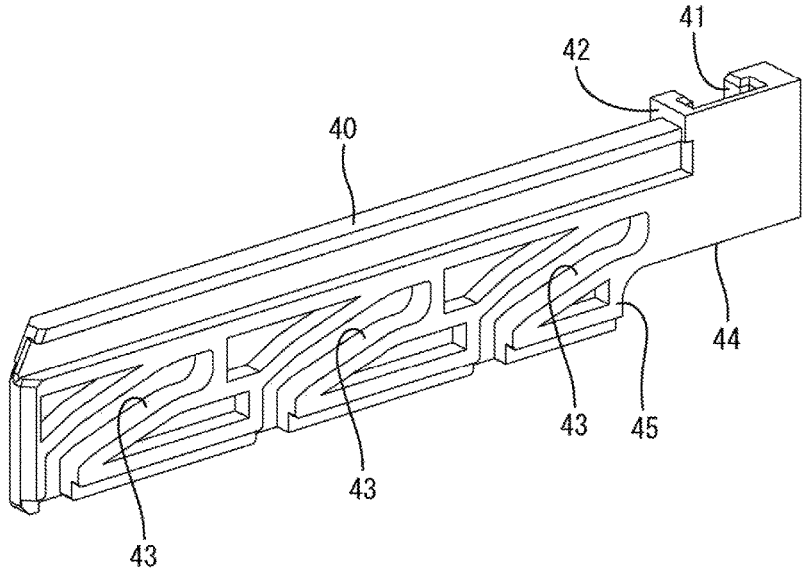
FIG. 15 is a perspective view of the slider.

As shown in FIG. 13, the lever 30 is a single component made of synthetic resin, including two arms 31 in the form of bilaterally symmetrical long plates, a roughly plate-like coupling 32 coupling base end parts 31R of the left and right arms 31 and a roughly plate-like operating portion 33 coupling tips 31F of the both left and right arms 31 to form a rectangular frame shape. The coupling 32 is formed with two bilaterally symmetrical rotary shafts 34 (rotation supports as claimed). The rotary shafts 34 project laterally in from both left and right inner side surfaces of a cutout 35 formed in the coupling 32. The rotary shafts 34 are disposed at positions inwardly of the inner surfaces of the arms 31.

The lever 30 is supported rotatably on the outer housing 11 of the housing 10 by fitting the pair of rotary shafts 32 to the pair of bearings 22. The rotary shafts 34 fit to the bearings 22 have relative downward, forward and rearward displacements with respect to the housing 10 restricted by being fit into the arcuate receiving portions 23 and have relative upward displacements with respect to the housing 10 restricted by being locked to the retaining projections 25.

Since the resilient locking pieces 24 formed with the retaining projections 25 are resiliently deformable in the lateral direction, the rotary shafts 24 are allowed to pass through the retaining projections 25 and reach fitting positions to the bearings 22 when the lever 30 is displaced from a position above the housing 10 to an assembled position. The lever 30 is rotatable in an angle range of about 90° between the assembled position (see FIGS. 7, 9) and an initial position (see FIG. 5) with the rotary shafts 34 fit to the bearings 22 serving as a fulcrum.

The lever 30 at the assembled position is oriented to lay the arms 31 in the front-rear direction (horizontal direction).

At this time, the coupling 32 is vertical (direction parallel to the connecting direction of the lever-type connector A and the mating connector 50), the cutout portion 35 is open down, and the rotary shafts 34 are located at a lower end part of the coupling 32 (cutout 35). The lever 30 at the initial position is oriented so that the arms 31 are vertical. At this time, the coupling 32 is horizontal (perpendicular to the connecting direction of the lever-type connector A and the mating connector 50) and the rotary shafts 34 ar at a front part of the coupling 32.

The lever 30 is held at a connection position (see FIGS. 1 to 3) set between the assembled position and the initial position by an unillustrated locking means. The lever 30 at the connection position is oriented such that front end sides (on the side of the operating portion 33) of the arms 31 are higher than rear ends (on the side of the coupling 32). At this time, the coupling 32 is slightly inclined from the vertically standing orientation, and the rotary shafts 34 are at the lower end part of the coupling 32. An angle of rotation of the lever 30 between the assembled position and the connection position is about 20° in this embodiment and the lever 30 (arms 31) is oriented to be nearly horizontal at the connection position.

Two bilaterally symmetrical escaping holes 36 are formed in left and right end parts of the coupling 32. The escaping hole 36 is a vertically long slit, and one longer inner side surface thereof is continuous and flush with the inner surface of the arm 31. Two bilaterally symmetrical restricting portions 37 (separation restricting portion and rotary shaft movement restricting portion as claimed) disposed coaxially with the rotary shafts 34 are formed on both left and right end parts of the coupling 32. When the lever 30 is at the assembled position and the connection position, the restricting portions 37 are at the lower end part of the coupling 32 and the upper surfaces of the restricting portions 37 face the escaping holes 36. When the lever 30 is at the initial position, the restricting portions 37 are at the front end of the coupling 32 and the rear surfaces of the restricting portions 37 faces the escaping holes 37.

Two bilaterally symmetrical drive shafts 38 (driving portions as claimed) are formed at positions slightly closer to the operating portion 33 than the coupling 32 on the inner surfaces of the base ends 31R of the left and right arms 31. When the lever 30 is at the assembled position and the connection position, the drive shafts 38 are above the rotary shafts 34 and in front of the rotary shafts 34. When the lever 30 is at the initial position, axial centers of the drive shafts 38 are above the rotary shafts 34 and behind the rotary shafts 34. As the lever 30 is rotated from the assembled position to the initial position, the drive shafts 38 are displaced rearward along arcuate paths in an area above the rotary shafts 34.

The sliders 40 are made of synthetic resin and are substantially in the form of bilaterally symmetrical flat plates whose plate thickness direction is aligned with the lateral direction. The sliders 40 are accommodated into the guide recesses 27 of the outer housing 11 and mounted slidably in the front-rear direction. Two bilaterally symmetrical driven recesses 41 are formed in the inner surfaces of the sliders 40. The driven recess 41 is disposed in a rear end part of the slider 40. The driven recess 41 is in the form of a groove long in the vertical direction and open in the upper end surface of the slider 40. The drive shafts 38 are accommodated into the driven recesses 41 from above the sliders 40. That is, an opening in the upper end of the driven recess 41 serves as an entrance for accommodating the drive shaft 38 into the driven recess 41.

The drive shaft 38 accommodated into the driven recess 41 has relative displacements in the front-rear direction with respect to the slider 40 restricted, but can be displaced in the vertical direction with respect to the slider 40 and can rotate about the drive shaft 38. By fitting the drive shafts 38 into the driven recesses 41, the sliders 40 move in parallel from an assembled position to an initial position via a connection position in conjunction with the rotation of the lever 30 from the assembled position to the initial position via the connection position. The assembled position of the slider 40 is set at the front end of a movement path of the slider 40, and the initial position is at the rear end of the movement path. The slider 40 at the assembled position has a movement in a direction opposite to that toward the initial position restricted by the contact of a front stop 42 formed on the upper end edge of the rear end part of the slider 40 with the outer housing 11.

Three cam grooves 43 inclined in both the vertical direction (connecting direction of the lever-type connector A and the mating connector 50) and the front-rear direction (sliding direction of the sliders 40) are formed at intervals in the front-rear direction on the inner surface (surface facing the connection space 16) of each of the sliders 40. An entrance in a lower end part of the cam groove 43 is open in the lower end surface of the slider 40. When the lever 30 and the sliders 40 are at the initial position, the entrances of the three cam grooves 43 communicate with the three entrance openings 29.

The restricting portions 37 and the lower end parts of the sliders 40 are located at the same height, and areas of the rear end parts of the sliders 40 at the same height as the restricting portions 37 serve as interference avoiding recesses 44 open in the lower and rear end edges of the sliders 40. A part of the lower end part of the slider 40 facing the front end of the interference avoiding recess 44 serves as a butting portion 45 facing the restricting portion 37 at the same height from front. When the slider 40 is at the assembled position, the restricting portion 37 is located behind the rear end of the slider 40. When the slider 40 is at the connection position, the restricting portion 37 is in a rear end part of the interference avoiding recess 44 and faces the rear end part of the slider 40 from below. When the slider 40 is at the initial position, the restricting portion 37 is at the front end of the interference avoiding recess 44 and is held in contact with the butting portion 45 from front or proximately facing the butting portion 45 from front.

Next, how to assemble the lever-type connector A is described.

First, the housing 10 is set in an assembled state, and the sliders 40 are mounted into the housing 10 and held at the assembled position. Subsequently, the lever 30 is mounted onto the housing 10 from above (from the side of the wire draw-out surface 19). At this time, the lever 30 is oriented such that the arms 31 are horizontal (same orientation as at the assembled position) and moved in parallel down while the restricting portions 37 slide in contact with the rear end edges of the sliders 40.

When the lever 30 is lowered to the assembled position, the rotary shafts 34 are fit to the bearings 22 and the drive shafts 38 are fit into the driven recesses 41 to complete the assembly of the lever 30 with the housing 10. Thereafter, the terminal fittings 17 are inserted into the housing 10 and the wire cover 46 is mounted on the housing 10 to complete the assembling of the lever-type connector A.

With the lever 30 and the sliders 40 located at the assembled position, the separation of the rotary shafts 34 from the bearings 22 is restricted only by locking the retaining projections 25 formed on the resiliently deformable resilient locking pieces 24 to the rotary shafts 34. Thus, if a force exceeding a locking force between the retaining projections 25 and the rotary shafts 34 acts on the lever 30, the rotary shafts 34 are separated from the bearing portions 22. Further, there is no locking means for restricting the mutual separation of the drive shafts 38 and the driven recesses 41.

Accordingly, the lever 30 is rotated to the connection position to restrict the separation of the lever 30 from the housing 10. When the sliders 40 are moved to the connection position in conjunction with the rotation of the lever 30, the rear end parts of the sliders 40 are located to face the restricting portions 37 from above. In this way, upward displacements of the restricting portions 37 with respect to the sliders 40 and the housing 10 are restricted and the upward separation of the rear end part of the lever 30 from the housing 10 is restricted. Since the restricting portions 37 are disposed coaxially with the rotary shafts 34, upward displacements of the rotary shafts 34 with respect to the housing 10 also are restricted and the rotary shafts 34 and the bearings 22 are held fit.

Further, with the lever 30 located at the assembled position, the entire lever 30 is disposed below (on the side of the front surface 10F of the housing 10) the surface of the housing 10 from which the wires 18 project. Thus, even if external matter approaches the housing 10 from above, it does not come into contact with the lever 30.

In connecting the lever-type connector A and the mating connector 50, the lever 30 and the sliders 40 are moved to the initial position. At this time, the restricting portions 37 come into contact with or face the butting portions 45 of the sliders 40 from behind. Thus, movements of the sliders 40 at the initial position in a direction (rearward direction) opposite to that toward the connection position are restricted. Thus, the lever 30 at the initial position is not rotated to a side opposite to the connection position. With the lever 30 and the sliders 40 located at the initial position, the inner housing 14 is fit shallowly into the receptacle 52 and the cam followers 53 are inserted into the entrances of the cam grooves 43. Thereafter, the operating portion 33 of the lever 30 is gripped to rotate the lever 30 toward the connection position. The lever 30 is displaced along the outer surface of the wire cover 46.

A distance from the rotary shafts 34 to the drive shafts 38 is shorter than a distance from the rotary shafts 34 to the operating portion 33. Hence, the sliders 40 are moved toward the connection position with a larger force than an operating force applied to the operating portion 33 by a boosting action due to the principle of leverage. As the sliders 40 are moved, the housing 10 is pulled toward the mating connector 50 by a boosting action due to the sliding contact of the cam grooves 43 and the cam followers 53. When the lever 30 and the sliders 40 reach the connection position, the connection of the lever-type connector A and the mating connector 5 is completed.

The lever-type connector A includes the housing 10, the lever 30 and the sliders 40. The lever 30 includes the arm portions 31, the coupling portion 32 coupling the base ends 31R (rear end parts) of the pair of arms 31 and the operating portion 32 coupling the tips 31F (front end parts) of the pair of arms 31. The lever 30 is rotatably supported on the housing 10 with the rotary shafts 34 formed on the coupling 32 as a fulcrum. Since not only the base end parts 31R of the arms 31, but also the tips 31F of the pair of arms 31 are coupled, the lever 30 has a high rigidity and is difficult to deform. The sliders 40 are mounted in the housing 10 while being fit to the drive shafts 38 of the lever 30, and slid in conjunction with the rotation of the lever 30. Further, the sliders 40 are formed with the cam grooves 43 with which the cam followers 53 of the mating housing 51 slide in contact as the pair of sliders 40 are slid.

Further, the rotary shaft 34 serving as a center of rotation of the lever 30 is substantially in the form of a cylindrical projection and has such a rigidity that the rotary shaft 34 is hardly resiliently deformed. On the other hand, the bearing 22 formed in the housing 10 includes the resilient locking piece 24 to be resiliently deformed so that the rotary shaft 34 is fit rotatably thereto. According to this configuration, the rotary shafts 34 can be fit to the bearings 22 even if the arms 31 of the lever 30 are not forcibly widened and deformed.

Further, the back surface 10R of the housing 10 serves as the wire draw-out surface 19 from which the wires 18 fixed to the terminal fittings 17 in the housing 10 are drawn out. When the lever 30 is at the assembled position where the lever 30 is assembled completely with the housing 10, the lever 30 is disposed along the outer periphery of the housing 10 and the entire lever 30 is disposed to be closer to the front surface 10F than to the rear surface 10R. According to this configuration, even if external matter approaches from the side of the back surface 10R of the housing 10 with the lever 30 at the assembled position and the wires 18 not drawn out from the wire draw-out surface 19, there is no possibility that the external matter interferes with the lever 30. Further, the lower end edge of the lever 30 at the assembled position is located at the same height as the front surface 10F of the housing 10.

Further, the lever 30 is rotatable from the assembled position where the lever 30 is completely assembled with the housing 10 to the initial position where the connection of the housing 10 and the mating housing 51 is started via the connection position where the connection of the housing 10 and the mating housing 51 is completed. The lever 30 is formed with the restricting portions 37 capable of restricting the separation of the lever 30 from the housing 10 by interfering with the sliders 40 when the lever 30 is located at the connection position with the drive shafts 38 fit to the sliders 40. According to this configuration, after the lever 30 is assembled with the housing 10, the lever 30 can be held assembled with the housing 10 by being rotated to the connection position.

Further, the restricting portions 37 are formed at the coupling 32 formed with the rotary shafts 34. In addition, the restricting portions 37 are disposed coaxially with the axial centers of the rotary shafts 34. According to this configuration, since the restricting portions 37 are arranged coaxially with the rotary shafts 34 (at positions near the rotary shafts 34), the separation of the rotary shafts 34 from the housing 10 is prevented. Further, the restricting portions 37 have both a function as a separation restricting portion for restricting the separation of the rotary shaft 34 from the housing 10 and a function as a movement restricting portion for restricting the rotation of the lever 30 at the initial position toward a side opposite to the connection position. Thus, the shape of the lever 30 can be simplified as compared to the case where the separation restricting portion and the movement restricting portion are formed separately.

Further, the lever 30 and the sliders 40 can be displaced in conjunction between the initial position where the connection of the housing 10 and the mating housing 51 is started and the connection position where the connection of the housing 10 and the mating housing 51 is completed. The lever 30 is formed with the restricting portions 37 for restricting displacements of the sliders 40 in a direction opposite to that toward the connection position by being held in contact with the sliders 40 with the lever 30 and the sliders 40 located at the initial position. According to this configuration, if an attempt is made to rotate the lever 30 at the initial position toward the side opposite to the connection position, the sliders 40 butt against the restricting portions 37 to have movements restricted. Thus, the rotation of the lever 30 is also restricted.

The invention is not limited to the above described and illustrated embodiment. For example, the following embodiments are also included in the scope of the invention.

Although the rotation supporting portions of the lever are in the form of projecting shafts in the above embodiment, the rotation supporting portions may be formed into hole- or recess-shaped bearings and fit to shaft portions of the housing.

Although the rotary shafts (rotation supporting portions) are formed at the positions inwardly of the inner surfaces of the arms in the above embodiment, the rotary shafts may be formed at positions outwardly of the outer surfaces of the arms.

Although the rotary shafts (rotation supporting portions) of the lever are formed into hardly resiliently deformable shafts in the above embodiment, the rotary shafts may be resiliently deformable. In this case, the bearings may be formed to be hardly resiliently deformable.

Although the entire lever is closer to the front surface than to the wire draw-out surface with the lever located at the assembled position in the above embodiment, a part of the lever may project farther rearward than the wire draw-out surface when the lever is at the assembled position.

Although the lever is assembled from the back side of the housing in the above embodiment, the lever may be assembled from the front surface side of the housing.

Although the connection position is set between the assembled position and the initial position within the rotational range of the lever in the above embodiment, the initial position may be set between the assembled position and the connection position.

Although the restricting portions serving as the separation rotary shafts are formed on the coupling in the above embodiment, the restricting portions may be formed on the arm portions.

Although the lever is formed with the restricting portions serving as the separation restricting portions in the above embodiment, the lever may not include the restricting portions.

Although the restricting portions serving as the movement restricting portions are formed on the coupling in the above embodiment, the restricting portions may be on the arms.

Although the lever is formed with the restricting portions as the movement restricting portions in the above embodiment, the lever may not include the movement restricting portions.

Although the restricting portion has both the function as the separation restricting portion and the function as the movement restricting portion in the above embodiment, the separation restricting portion and the movement restricting portion may be formed separately.

Although the separation restricting portions are formed on the coupling in the above embodiment, the separation restricting portions may be formed on the base ends of the arms.

Although the movement restricting portions are formed on the coupling in the above embodiment, the movement restricting portions may be formed on the base ends of the arms.

Although the restricting portions (separation restricting portions, movement restricting portions) are formed at the positions inwardly of the inner surfaces of the arms in the above embodiment, the restricting portions may be formed at positions outwardly of the outer surfaces of the arms.

LIST OF REFERENCE SIGNS

A . . . lever-type connector
10 . . . housing
10F . . . front surface of housing
10R . . . back surface of housing
17 . . . terminal fitting
18 . . . wire
19 . . . wire draw-out surface
22 . . . bearing
30 . . . lever
31 . . . arm
31F . . . tip part of arm
31R . . . base end part of arm
32 . . . coupling
33 . . . operating portion
34 . . . rotary shaft (rotation supporting portion)
37 . . . restricting portion (separation restricting portion, movement restricting portion)
38 . . . drive shaft (driving portion)
40 . . . slider
43 . . . cam groove
51 . . . mating housing
53 . . . cam follower

What is claimed is:

1. A lever-type connector, comprising:

a housing;

a lever including two arms, a coupling coupling base end parts of the arms and an operating portion coupling tip parts of the arms, and rotatably supported on the housing with the coupling or rotation supporting portions formed on the base end parts of the arms serving as a fulcrum;

two sliders mounted in the housing while being fit to driving portions of the lever and configured to slide in conjunction with the rotation of the lever; and cam grooves formed in the sliders and configured such that cam followers of a mating housing slide in contact with the cam grooves as the sliders are slid.

2. The lever-type connector of claim 1, wherein:

the rotation supporting portions are shafts; and the housing is formed with bearings resiliently deformable and configured such that the rotation supporting portions are fit rotatably to the bearings.

3. The lever-type connector of claim 2, wherein:

a back surface of the housing defines as a wire draw-out surface from which a wire fixed to a terminal fitting in the housing is drawn out; and the lever is disposed along an outer periphery of the housing and the entire lever is disposed closer to a front surface than to the back surface when the lever is at an assembled position where the lever is completely assembled with the housing.

4. The lever-type connector of claim 3, wherein:

the lever is rotatable from an assembled position where the lever is completely assembled with the housing to an initial position where connection of the housing and the mating housing is started via a connection position where the connection of the housing and the mating housing is completed; and the lever is formed with a separation restricting portion capable of restricting separation of the lever from the housing by interfering with at least one of the sliders when the lever is at the connection position with the driving portions fit to the sliders.

5. The lever-type connector of claim 4, wherein the separation restricting portion is formed on the coupling or the base ends of the pair of arms.

6. The lever-type connector of claim 1, wherein:

the lever and the sliders are displaceable in conjunction between an initial position where connection of the housing and the mating housing is started and a connection position where the connection of the housing and the mating housing is completed; and the lever is formed with a movement restricting portion configured to restrict displacements of the sliders in a direction opposite to that toward the connection position by being held in contact with the sliders when the lever and the sliders are at the initial position.

7. The lever-type connector of claim 1, wherein:

a back surface of the housing defines as a wire draw-out surface from which a wire fixed to a terminal fitting in the housing is drawn out; and the lever is disposed along an outer periphery of the housing and the entire lever is disposed closer to a front surface than to the back surface when the lever is at an assembled position where the lever is completely assembled with the housing.

8. The lever-type connector of claim 1, wherein:

the lever is rotatable from an assembled position where the lever is completely assembled with the housing to an initial position where connection of the housing and the mating housing is started via a connection position where the connection of the housing and the mating housing is completed; and the lever is formed with a separation restricting portion capable of restricting separation of the lever from the housing by interfering with at least one of the sliders when the lever is at the connection position with the driving portions fit to the sliders.

9. The lever-type connector of claim 8, wherein the separation restricting portion is formed on the coupling or the base ends of the pair of arms.

* * * * *